United States Patent [19]

Wilson

[11] 4,300,621

[45] Nov. 17, 1981

[54] CONTINOUS CASTING METHOD WITH VAPORIZED COOLANT

[75] Inventor: Robert Wilson, Dundee, Scotland

[73] Assignee: Timex Corporation, Waterbury, Conn.

[21] Appl. No.: 145,197

[22] Filed: Apr. 29, 1980

Related U.S. Application Data

[63] Continuation of Ser. No. 959,955, Nov. 13, 1978, abandoned.

[51] Int. Cl.[3] ..... B22D 11/00

[52] U.S. Cl. ..... 164/485; 164/440; 165/DIG. 14

[58] Field of Search ..... 164/440, 443, 82; 165/DIG. 14

[56] References Cited

U.S. PATENT DOCUMENTS 3,850,225 11/1974 McNitt et al. ..... 164/440 X

FOREIGN PATENT DOCUMENTS 486205 2/1976 U.S.S.R. ..... 165/DIG. 14

*Primary Examiner*—Robert D. Baldwin

*Attorney, Agent, or Firm*—William C. Crutcher; Edward J. Timmer

[57] ABSTRACT

The disclosed continuous casting mold is especially constructed for use with a vaporizable coolant which is nonreactive with the molten metal being cast or the mold itself and includes an inner mold body having a longitudinal solidification chamber therethrough, an intermediate mold body surrounding and spaced from the inner mold body to define an annular cooling chamber therebetween and an outer mold body surrounding and spaced from the intermediate mold body to define an annular manifold chamber therebetween. Coolant access means associated typically with the outer mold body provides entry for coolant into the manifold chamber. The intermediate mold body includes coolant access means adjacent one end of the mold and coolant discharge means adjacent the other end so that coolant from the manifold chamber enters the cooling chamber at one end of the mold and flows around and along the length of the inner mold body to the other end where it is discharged, the coolant absorbing heat from the inner mold body and solidifying metal therein as it travels through the cooling chamber.

3 Claims, 2 Drawing Figures

CONTINOUS CASTING METHOD WITH VAPORIZED COOLANT

This is a continuation of Application Ser. No. 959,555, filed Nov. 13, 1978, now abandoned.

FIELD OF THE INVENTION

The present invention relates to the continuous casting of metals and, more particularly, to cooling techniques for use in such processes.

DESCRIPTION OF THE PRIOR ART

Continuous casting of both ferrous and nonferrous metals and alloys is a well known technique in the metallurgical art, for example, as represented by the Rossi et al patent, U.S. Pat. No. 3,399,716 issued Sept. 3, 1968, among many others. Of course, in such a dynamic process which transforms hot molten metal into a solid metal shape, the mold in which solidification occurs plays an extremely important part in the process. In the continuous casting of ferrous alloys, water-cooled copper molds have been successfully utilized. On the other hand, for nonferrous metals and alloys such as copper and its alloys and aluminum and its alloys, water-cooled graphite molds have found widespread use, for example, as represented by the Kolle patent, U.S. Pat. No. 3,459,255 issued Aug. 5, 1969, and the Adamec et al patent, U.S. Pat. No. 3,592,259 issued Dec. 10, 1971. As further illustrated in the Woodburn patent, U.S. Pat. No. 3,590,904 issued July 6, 1971, water-cooled graphite molds have also been utilized in casting slabs or ingots of metals and alloys in a noncontinuous manner.

In the continuous casting of nonferrous metals, particularly brass and aluminum, in water-cooled graphite molds, there are two serious explosion hazards. The first involves the possibility of contact between the water coolant circulating inside the mold and hot molten metal as a result of leaks and the like. The second involves a graphite steam reaction which generates explosive hydrogen gas as a reaction product. The graphite steam reaction may occur when excessive water contacts the graphite at temperatures around 1000°-1100° C. In the aforementioned Kolle patent, the exposed surfaces of the graphite mold are coated with a thin layer of silver to help avoid conditions conducive to these hazards. The coating is particularly essential when a low density graphite is employed as the mold material.

SUMMARY OF THE INVENTION

The present invention provides an improved system for continuous casting molten metal and for overcoming the disadvantageous explosion hazards associated with the prior art. The improved system is especially constructed for use with a coolant which is nonreactive with most any molten metal and mold material, including graphite.

Typically, the mold of the invention includes an inner mold body having a longitudinal solidification chamber therethrough with an inlet end for receiving molten metal and an outlet end through which solidified metal exits, an intermediate mold body surrounding and spaced from the inner mold body to define an annular cooling chamber therebetween along the length of the mold and an outer mold body surrounding and spaced from the intermediate mold body to define an annular manifold chamber therebetween. Preferably, the mold bodies comprise tubular graphite members of increasing diameter in concentric relationship to one another. The outer mold body preferably includes access means providing entry into the manifold chamber for a coolant which is nonreactive with the molten metal and mold, liquid or gaseous nitrogen being the preferred coolant. The intermediate mold body includes coolant access means adjacent one end of the mold, preferably the inlet end thereof, and coolant discharge means at the other end, preferably at the outlet end, the coolant access means being spaced about the periphery of the inner mold body for admitting coolant from the manifold chamber into the cooling chamber substantially uniformly around the inner mold body. In this way, the coolant enters the cooling chamber at one end of the mold and flows around and along the length of the inner mold body to the other end where it is exhausted from the chamber. The coolant absorbs heat from the inner mold body and solidifying metal therein without the risk of explosion hazards resulting from the coolant contacting the molten metal or from the coolant reacting with the mold itself.

In a preferred embodiment of the invention for use with a vaporizable coolant, the intermediate and outer mold bodies define an annular manifold and vaporizer chamber therebetween along the length of the mold. Liquid nitrogen coolant is preferably introduced into this chamber adjacent the outlet end of the mold and vaporized as it flows toward the inlet end where it enters the cooling chamber via coolant gas access means associated with the intermediate mold body. After flowing around the inner mold body along the length of the mold, the vaporized nitrogen coolant is exhausted from the cooling chamber by coolant gas discharge means adjacent the outlet end.

DESCRIPTION OF THE PREFERRED EMBODIMENT

Figure 1:
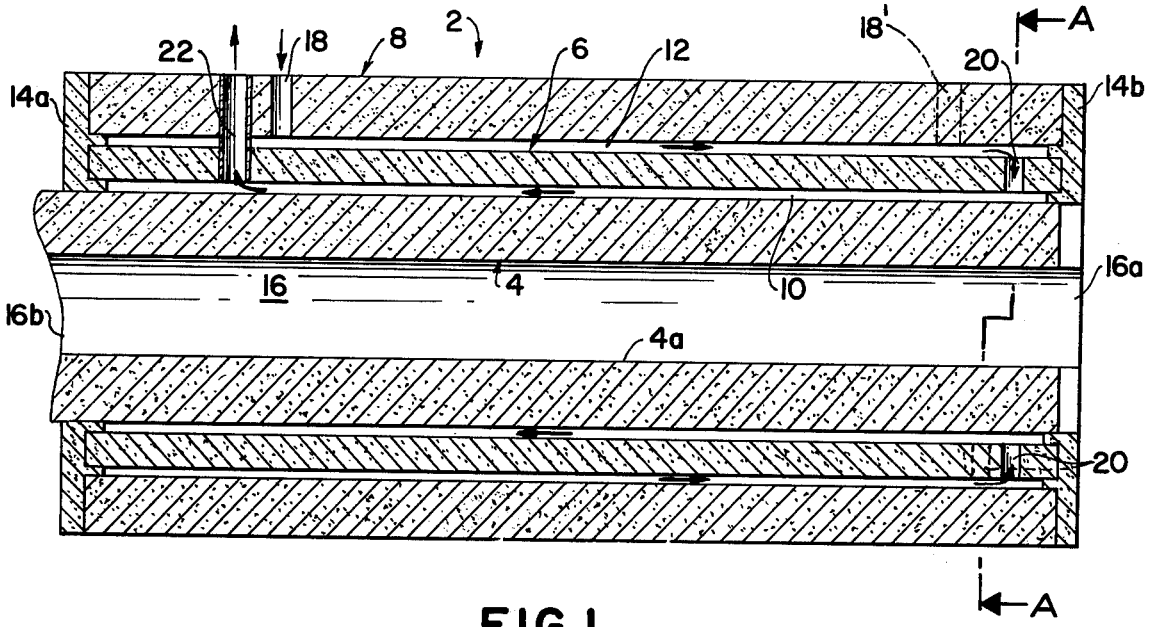
FIG. 1 is a cross-sectional view through the longitudinal axis of the mold of the invention.

A typical mold of the invention is illustrated in cross-section in FIG. 1. Although graphite is a preferred material for the mold, other refractory materials will of course be usable and can be selected as desired depending upon the nature of the metal or alloy to be cast among other factors. The graphite mold described more fully herein below has proved especially satisfactory in continously casting leaded brass (60 w/oCU,40 w/o ZN, 2 w/o Pb) having a solidification temperature of about 870°-880° C. The mold 2 includes an inner mold body 4, intermediate mold body 6, and outer mold body 8 in the form of concentric graphite tubes. As shown, the intermediate mold body surrounds and is laterally spaced from the inner mold body to define an annular cooling chamber 10 therebetween along the length of the mold whereas the outer mold body is in the same relationship to the intermediate mold body to define an annular manifold chamber 12 therebetween along the length of the mold. Annular graphite end caps **14*a* and 14*b* not only seal the ends of the graphite tubes but also serve as spacers to maintain the desired separation between the tubes. The inner mold tube 4 includes an internal wall 4*a* which defines a cylindrical solidification chamber 16 longitudinally therethrough having an inlet end 16***a* for connection to the discharge nozzle of a conventional crucible (not shown) or other vessel containing molten metal to be continuously cast and an outlet end 16*b* through which the solidified product exists.

Figure 2:
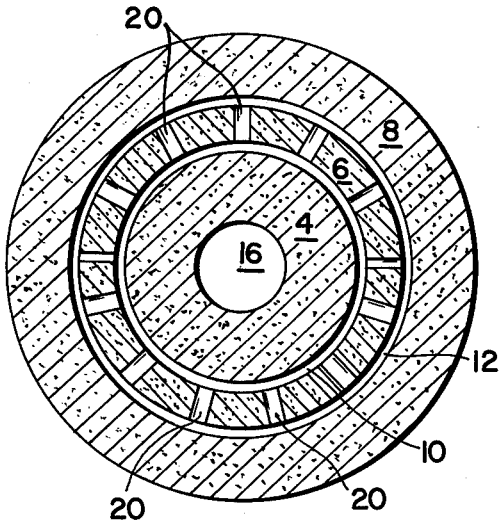
FIG. 2 is a cross-sectional view along line A—A of FIG. 1 showing coolant access ports in the intermediate mold body.

As shown in FIG. 1, outer graphite tube 8 includes an aperture 18 or other coolant access means through which a vaporizable coolant which is nonreactive with the molten metal or mold can be introduced into the manifold chamber 12 adjacent the outlet end of the mold. As mentioned, liquified nitrogen is a preferred coolant exhibiting the required nonreactivity. Of course, the liquified nitrogen coolant can be obtained from a conventional storage cylinder and introduced under pressure into chamber 12 via suitable pressure fittings (not shown). When liquified nitrogen or other vaporizable coolants are employed with the mold, the manifold chamber 12 also functions as a vaporizer chamber in the following manner. As indicated by the arrows, the liquified nitrogen flows from near the outlet end 16*b* of the mold 2 toward the inlet end 16*a* along the length of the manifold and vaporizer chamber 12. During this longitudinal flow, the nitrogen absorbs sufficient heat from the intermediate and outer mold bodies to vaporize by the time it reaches the vicinity of the inlet end 16*a*. Typically, upon vaporization in chamber 12, the nitrogen expands in volume in the ratio of approximately 1 to 800. The vaporized nitrogen then flows into the cooling chamber 10 via a plurality of spaced, radial apertures 20, FIG. 2, adjacent the inlet end where molten metal enters the mold. Apertures 20 or other coolant access means are spaced around the circumference of the intermediate graphite tube 6 as shown to provide uniform flow of coolant around the outer circumference of inner graphite tube 4. Inner graphite tube 4 is provided adjacent its outlet 16*b* with coolant gas discharge aperture 22 or other discharge means for exhausting the vaporized nitrogen from the cooling chamber 10 after it flows along the length thereof. Of course, flow of the vaporized nitrogen from the inlet end to the outlet end of the mold in the cooling chamber 12 effects considerable heat removal from the inner graphite tube 4 and solidifying metal therein.

Although liquidified nitrogen has been described as the coolant in the detailed embodiment of the invention, it will be apparent that other coolants such as liquified helium, liquified carbon dioxide and others may also find use in the invention. However, it is not essential that nitrogen or any other coolant be introduced into annular chamber 12 in liquified form, although this is preferred. For example, gaseous nitrogen has been injected into manifold chamber 12, through apertures 20 and then through cooling chamber 10 for cooling purposes and produced satisfactory results in terms of effecting solidification of the molten metal in solidification chamber 16. Since the metal is solidified and substantially cooled in the mold 2, it is possible to further cool the solidified product exiting outlet end 16*b* by means of a water-cooled secondary graphite mold. A water-cooled mold may be used for this purpose without risk of explosion since the metal is already solidified and substantially cooled.

Of course, other modifications to the preferred embodiment can also be made and will be apparent to those skilled in the art. For example, the coolant access aperture 18 through the outer mold body may be positioned nearer to the inlet end 16*a* of the mold body as indicated by the dashed lines 18′. In addition, the shape of the mold bodies 4, 6, and 8 may be other than tubular and the cross-sectional shape of the solidification chamber can be varied to produce most any desired product shape. It is intended to cover these and other modifications which will occur to those skilled in the art in the claims appended hereto.

I claim:

1. A method for continuously casting molten metal, comprising:

(a) providing a continuous casting mold comprising an inner mold body having a longitudinal solidification chamber therethrough with an inlet end for receiving molten metal and an outlet end through which solidified metal exits, an intermediate mold body laterally surrounding and spaced from the inner mold body to define an annular cooling chamber therebetween along the length of said mold bodies, and an outer mold body laterally surrounding and spaced from the intermediate mold body to define an annular manifold and vaporizer chamber therebetween along the length of said mold bodies;

(b) passing molten metal continuously through the solidification chamber of said inner mold body, and concurrently cooling the molten metal to effect solidification thereof by passing a vaporizable, nonreactive liquid coolant through said manifold and vaporizer chamber during which said coolant absorbs heat and is vaporized, increasing significantly in volume and velocity, and then passing the vaporized coolant through said cooling chamber during which the vaporized coolant absorbs heat from the inner mold body to solidify the molten metal passing therethrough.

2. The casting method of claim 1 wherein the vaporizable, liquid coolant is passed from adjacent the mold outlet end to the mold inlet end within said manifold and vaporizer chamber and then the vaporized coolant is passed from the mold inlet end toward the mold outlet end in said cooling chamber.

3. The casting method of claim 1 wherein the vaporizable, liquid coolant is liquified nitrogen.

* * * * *